US005080071A

United States Patent [19]

Minamitani et al.

[11] Patent Number: 5,080,071

[45] Date of Patent: Jan. 14, 1992

[54] FUEL CONTROL SYSTEM FOR INTERNAL COMBUSTION ENGINE

[75] Inventors: Kunitomo Minamitani; Tetsuro Takaba; Terufumi Yamashita; Yuji Sato, all of Hiroshima, Japan

[73] Assignee: Mazada Motor Corporation, Hiroshima, Japan

[21] Appl. No.: 540,281

[22] Filed: Jun. 19, 1990

[30] Foreign Application Priority Data

Jun. 20, 1989 [JP] Japan ..... 1-155853

[51] Int. Cl.[5] ..... F02D 41/10; F02D 41/12; F02D 41/18

[52] U.S. Cl. ..... 123/478; 123/492; 123/493

[58] Field of Search ..... 123/478, 480, 492, 493

[56] References Cited

U.S. PATENT DOCUMENTS

| | | | |
|---|---|---|---|
| 4,227,490 | 10/1980 | Kobayashi et al. | 123/493 |
| 4,357,923 | 11/1982 | Hideg | 123/492 |
| 4,359,993 | 11/1982 | Carlson | 123/492 |
| 4,388,906 | 6/1983 | Sugiyama et al. | 123/493 |
| 4,452,212 | 6/1984 | Takase | 123/493 |
| 4,454,847 | 6/1984 | Isomura et al. | 123/492 |
| 4,667,640 | 5/1987 | Sekozawa et al. | 123/492 |
| 4,852,538 | 8/1989 | Nagaishi | 123/493 |
| 4,903,668 | 2/1990 | Ohata | 123/478 |
| 4,905,653 | 3/1990 | Manaka et al. | 123/480 |
| 4,919,094 | 4/1990 | Manaka et al. | 123/493 |
| 4,939,658 | 7/1990 | Sekozawa et al. | 123/480 |
| 4,953,530 | 9/1990 | Manaka et al. | 123/492 |

FOREIGN PATENT DOCUMENTS

| | | |
|---|---|---|
| 0115868 | 8/1984 | European Pat. Off. . |
| 0184626 | 6/1986 | European Pat. Off. . |

*Primary Examiner*—Tony M. Argenbright
*Assistant Examiner*—Robert E. Mates
*Attorney, Agent, or Firm*—Sixbey, Friedman, Leedom & Ferguson

[57] ABSTRACT

In a fuel control system for an internal combustion engine, fuel is injected in a quantity the direct delivery part of which provides a desired quantity of fuel to be actually fed to the engine together with the drawn part of the intake-manifold wetting fuel. The quantity of the intake-manifold wetting fuel on the basis of which the quantity of the drawn part is calculated is calculated on the basis of the quantity of the adhering part of the fuel which was injected by the preceding injection and the quantity of the residual part of the preceding intake-manifold wetting fuel.

10 Claims, 9 Drawing Sheets

FUEL CONTROL SYSTEM FOR INTERNAL COMBUSTION ENGINE

BACKGROUND OF THE INVENTION

1. Field of the Invention

This invention relates to a fuel control system for an internal combustion engine, and more particularly to a fuel control system for a fuel injection type internal combustion engine.

2. Description of the Prior Art

In a fuel injection type internal combustion engine, a basic quantity of fuel to provide a desired air-fuel ratio is calculated according to the quantity of intake air for each cycle and the fuel is injected into the intake system of the engine in the basic quantity for each cycle.

However this method of feeding fuel is disadvantageous in the following point. That is, the fuel cannot be sufficiently vaporized and atomized, and a relatively large part of the fuel injected for each cycle adheres to the wall surface of the intake passage and does not enter the combustion chamber though a part of the fuel vaporizes and enters the combustion chamber during the next injection. Accordingly, the quantity of the fuel actually fed to the combustion chamber for each cycle largely deviates from the required quantity, which can deteriorate the operating performance of the engine and can give rise to a problem in emission control.

In Japanese Unexamined Patent Publication No. 58(1983)-8238, there is disclosed a method of controlling the quantity of fuel to be injected in which the quantity of fuel which is actually fed to the engine is determined on the basis of both the direct delivery part and the drawn part, the former being the part of the fuel to be directly delivered to the combustion chamber from the fuel injector and the latter being the part of the fuel which once adheres to the wall surface of the intake passage, and is vaporized and fed to the combustion chamber. In accordance with this method, the quantity of the fuel to be injected is determined taking into account both the direct delivery part and the drawn part, and accordingly the quantity of the fuel actually fed to the combustion chamber for each cycle approximates to the required quantity.

However, in this method, the quantity of the fuel which adheres to the wall surface of the intake passage on the basis of which the quantity of the drawn part is calculated is estimated on the basis of the quantity of the fuel which is to be fed to the engine. Accordingly, so long as the engine is in a steady state, a relatively good operation of the engine can be obtained, but during an asynchronous fuel injection as during acceleration, the quantity of the fuel which is asynchronously injected is not taken into account and the quantity of the fuel on the wall surface of the intake passage cannot be correctly estimated, which adversely affects the accuracy of fuel control.

SUMMARY OF THE INVENTION

In view of the foregoing observations and description, the primary object of the present invention is to provide a fuel control system which can feed fuel to the engine in an optimal quantity irrespective of whether the engine is in a steady state.

In the fuel control system in accordance with the present invention, the fuel is injected in a quantity the direct delivery part of which provides a desired quantity of fuel to be actually fed to the engine together with the drawn part of the intake-manifold wetting fuel and characterized in that the quantity of the intake-manifold wetting fuel on the basis of which the quantity of said drawn part is calculated is calculated on the basis of the quantity of the adhering part of the fuel which was injected by the preceding injection and the quantity of the residual part of the preceding intake-manifold wetting fuel. The definitions of the terms "direct delivery part", "drawn part", "intake-manifold wetting fuel", "adhering part" and "residual part" will become apparent later.

The present invention has been made based on the following realization.

As shown in FIG. 1, a part 3 of fuel injected from a fuel injector 1 adheres to the wall surface of the intake passage 2 of an engine E and the other part 5 of the fuel is directly introduced into a combustion chamber 4. The part 3 which adheres to the wall surface of the intake passage 2 is referred to as "the adhering part" and the part 5 which is directly introduced into the combustion 4 is referred to as "the direct delivery part". A part 7 of fuel 6 which has adhered to the wall surface of the intake passage 2 is vaporized and is introduced into the combustion chamber 4 together with the direct delivery part 5 at each injection and the other part of the fuel 6 remains there. The former part 7 is referred to as "the drawn part" and the latter part is referred to as "the residual part". The fuel 6 which has adhered to the wall surface of the intake passage 2 is referred to as "the intake-manifold wetting fuel", and comprises the adhering part 3 of the fuel injected by the preceding injection and the residual part of the intake-manifold wetting fuel at the preceding injection.

That is, when a basic injection pulse width is represented by $\tau a$, a wet correction injection pulse width (minus the ineffective injection time) is represented by $\tau e$, the quantity of the intake-manifold wetting fuel is represented by $\tau m$, the proportion of the direct delivery part is represented by u ($0<\alpha\leqq 1$), and the proportion of the drawn part is represented by $\beta$ ($0<\beta\leqq 1$), the quantity of the adhering part 3 of the fuel injected by the preceding injection is represented by $(1-\alpha)\cdot\tau e(i-1)$ and the quantity of the residual part at the preceding injection is represented by $(1-\beta)\cdot\tau m_{(i-1)}$. (The variables attached with (i) and (i−1) respectively represent the value at each injection and at the preceding injection.) Accordingly, the quantity of the intake-manifold wetting fuel is represented by the following formula.

$$\tau m_{(i)}=(1-\alpha)\cdot\tau e_{(i-1)}+(1-\beta)\cdot\tau m_{(i-1)} \quad (1)$$

The total quantity of fuel to be actually introduced into the combustion chamber $\tau cyl$ is represented by the following formula.

$$\tau cyl_{(i)}=\alpha\cdot e_{(i)}+\beta\cdot\tau m_{(i)} \quad (2)$$

Since the wet correction should be made so that the total quantity of fuel to be actually introduced into the combustion chamber $\tau cyl$ becomes equal to the quantity corresponding to the basic fuel injection pulse width $\tau a$, $\tau a$ is substituted for $\tau cyl$ in formula (2), thereby obtaining the following formula.

$$\tau a_{(i)}=\alpha\cdot\tau e_{(i)}+\beta\cdot\tau m_{(i)} \quad (3)$$

Accordingly the wet correction fuel injection pulse width is obtained from the following formula.

$$\tau e_{(i)} = \{\tau a_{(i)} - \beta \cdot \tau m_{(i)}\}/\alpha \quad (4)$$

$\tau m_{(i)}$ in formula (4) is given by formula (1).

The values of the proportion of the direct delivery part and the proportion of the drawn part are empirically determined.

Based on the concept described above, the quantity of the intake-manifold wetting fuel on the basis of which the quantity of the drawn part is calculated is calculated on the basis of the quantity of the adhering part of the fuel which was injected by the preceding injection and the quantity of the residual part of the preceding intake-manifold wetting fuel.

DESCRIPTION OF THE PREFERRED EMBODIMENTS

Figure 1:
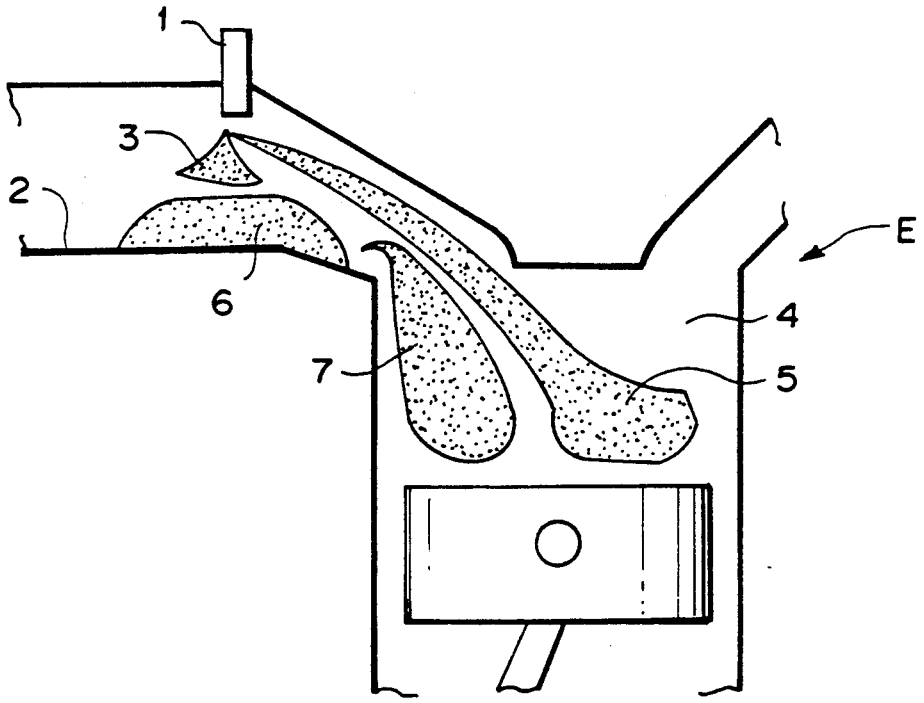
FIG. 1 is a view for illustrating the principle of the fuel control system of the present invention.
Figure 2:
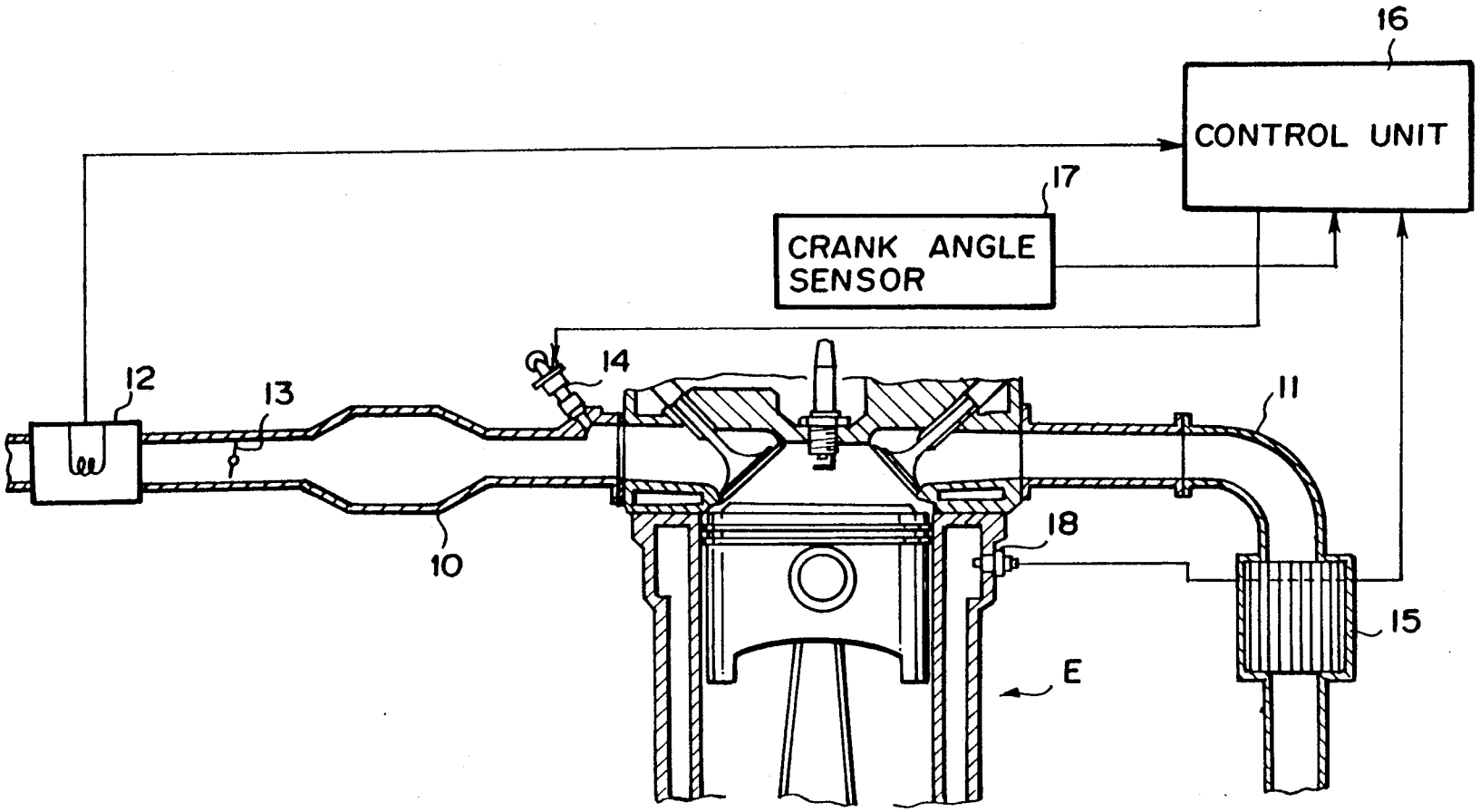
FIG. 2 is a schematic view of an fuel control system in accordance with an embodiment of the present invention.

In FIG. 2, an engine E provided with a fuel control system in accordance with an embodiment of the present invention has an intake passage 10 and an exhaust passage 11. An airflow meter 12, a throttle valve 13 and a fuel injection valve 14 are provided in the intake passage 10 in this order from upstream. A catalytic convertor 15 is provided in the exhaust passage 12.

The fuel injection valve 14 is controlled by a control unit 16 which is of a microcomputer. The control unit 16 receives output signals from the airflow meter 12, a crank angle sensor 17 which detects the engine speed and a water temperature sensor 18 which detects the temperature of cooling water, and determines the opening time of the fuel injection valve 14 on the basis of the output signals.

Figure 3:
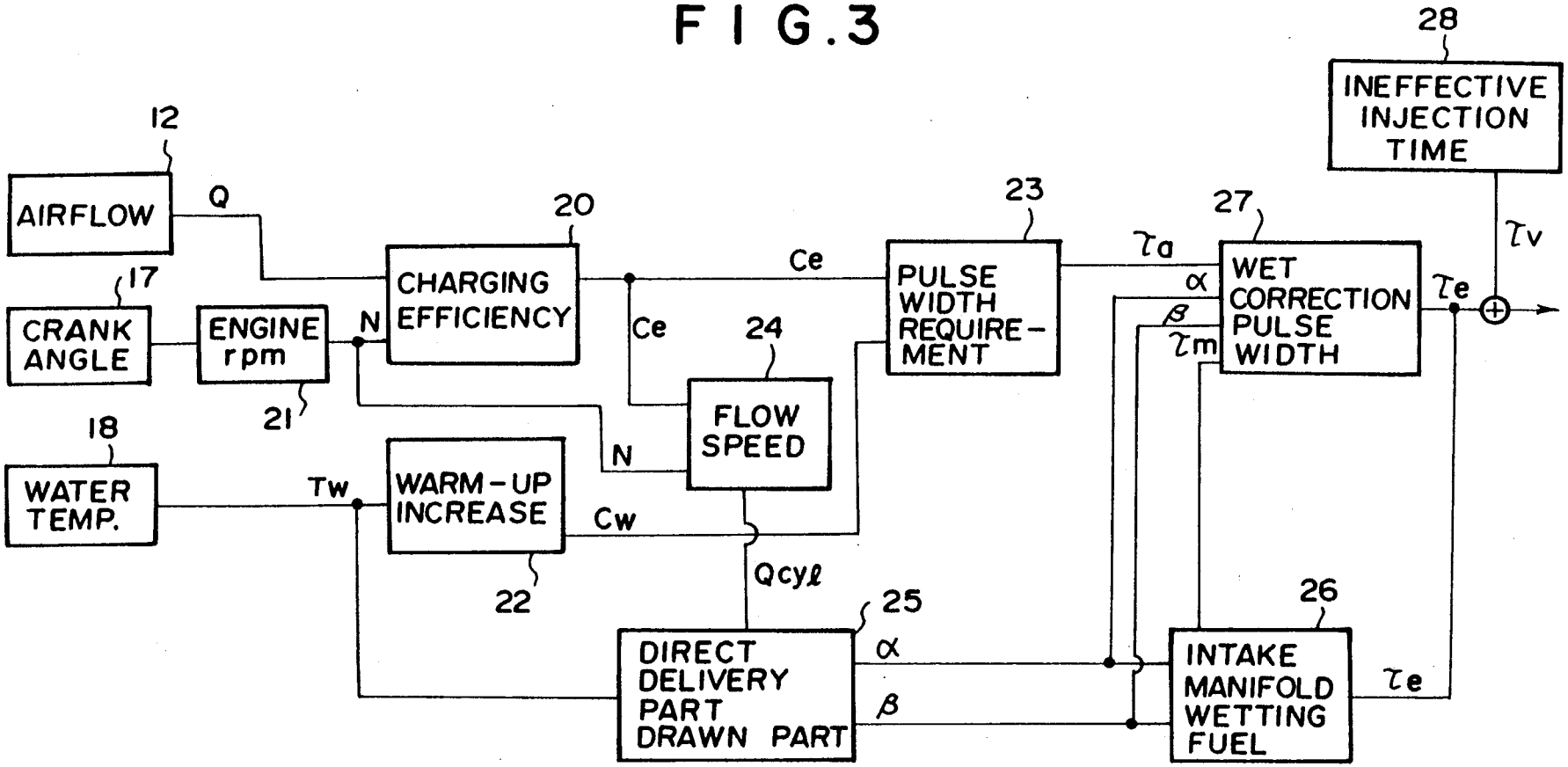
FIG. 3 is a block diagram for illustrating the operation of the fuel control system shown in FIG. 2.
Figure 4:
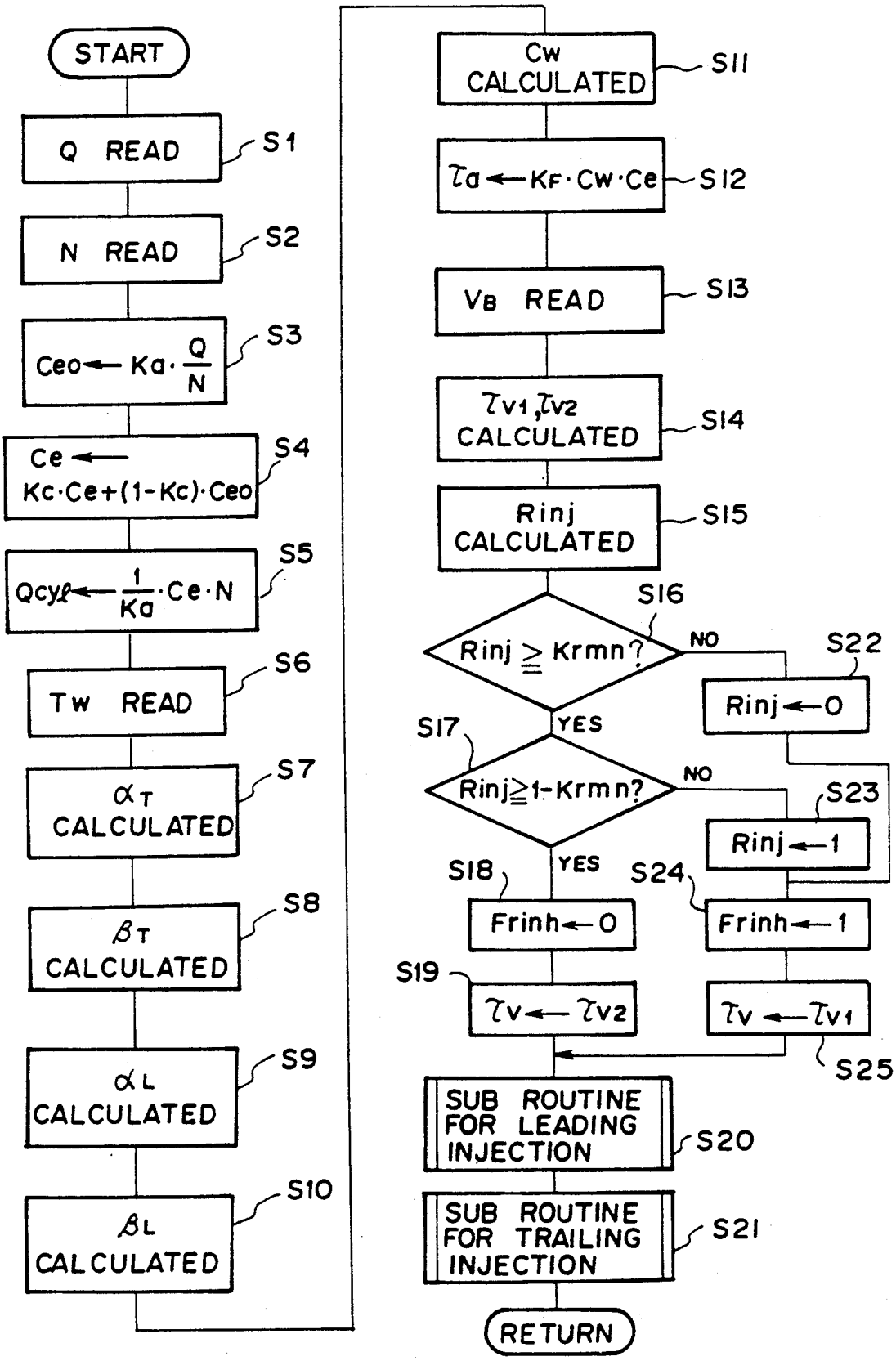
FIG. 4 is a flow chart showing a main routine which the control unit executes.

FIG. 3 is a block diagram for briefly illustrating the control to be executed by the control unit 16 in order to determine the width of the fuel injection pulse which determines the opening time of the fuel injection valve 14, thereby determining the quantity fuel to be injected by the fuel injection valve 14.

In FIG. 3, reference numeral 20 denotes a cylinder charging efficiency calculating section which calculates the cylinder charging efficiency Ce on the basis of the output Q of the airflow meter 12 and an output N of an engine speed calculating section 21 which calculates the engine speed on the basis of the output of the crank angle sensor 17. The cylinder charging efficiency calculating section 20 calculates the cylinder charging efficiency Ce according to formula $$Kc \cdot Ce + (1 - Kc) \cdot CeO$$

wherein $CeO = Ka \cdot Q/N$, and Ka and Kc are constants.

A warm-up fuel increase calculating section 22 is provided in parallel to the cylinder charging efficiency calculating section 20, and the water temperature sensor 18 is connected thereto. The warm-up increase calculating section 22 receives the water temperature signal Tw from the water temperature sensor 18 and calculates fuel increase for warm-up Cw according to the temperature of the cooling water represented by the water temperature signal Tw. Normally, the warm-up increase calculating section 22 reads out the fuel increase for warm-up from a fuel increase for warm-up-water temperature characteristic map stored therein.

The cylinder charging efficiency calculating section 20 and the warm-up fuel increase calculating section 22 are connected to a fuel injection pulse width requirement calculating section 23. The fuel injection pulse width requirement calculating section 23 calculates a width requirement of the fuel injection pulse, i.e., the basic fuel injection pulse width $\tau a$, on the basis of the cylinder charging efficiency Ce calculated by the cylinder charging efficiency calculating section 20 and the fuel increase for warm-up Cw calculated by the warm-up fuel increase calculating section 22.

A flow speed calculating section 24 which calculates the flow speed of intake air Qcyl at the fuel injection valve 14 is connected to the cylinder charging efficiency calculating section 20, and the engine speed calculating section 21 is connected to the flow speed calculating section 24. The flow speed calculating section 24 calculates the flow speed of intake air Qcyl at the fuel injection valve 14 according to formula $$1/Ka \cdot Ce \cdot N$$

on the basis of the cylinder charging efficiency Ce calculated by the cylinder charging efficiency calculating section 20 and the engine speed N calculated by the engine speed calculating section 21.

To the flow speed calculating section 24 is connected a direct delivery part and drawn part calculating section 25 which calculates the proportion of the direct delivery part u and the proportion of the drawn part $\beta$, and the water temperature sensor 18 is also connected to the direct delivery part and drawn part calculating section 25. The direct delivery part and drawn part calculating section 25 stores maps of the proportion of the direct delivery part $\alpha$ and the proportion of the drawn part $\beta$ in which the flow speed of intake air Qcyl at the fuel injection valve 14 and the water temperature are used as parameters, and reads out the values of the proportion of the direct delivery part $\alpha$ and the proportion of the drawn part $\beta$ from the maps according to the flow speed of intake air Qcyl at the fuel injection valve 14 calculated by the flow speed calculating section 24 and the water temperature represented by the water temperature signal Tw.

An intake-manifold wetting fuel calculating section 26 is connected to the direct delivery part and drawn part calculating section 25, and calculates the quantity of the intake-manifold wetting fuel $\tau m$ according to the values of the proportion of the direct delivery part $\alpha$ and the proportion of the drawn part $\beta$ calculated by the direct delivery part and drawn part calculating section 25 and the preceding wet correction injection pulse width $\tau e$ on the basis of formula (1), that is, $\tau m_{(i)}=(1-\alpha)\cdot\tau e_{(i-1)}+(1-\beta)\cdot\tau m_{(i-1)}$.

A wet correction injection pulse width calculating section 27 is connected to the fuel injection pulse width requirement calculating section 23, the direct delivery part and drawn part calculating section 25 and the intake-manifold wetting fuel calculating section 26. The wet correction injection pulse width calculating section 27 calculates the wet correction injection pulse width $\tau e$ according to the values of the proportion of the direct delivery part $\alpha$ and the proportion of the drawn part $\beta$ calculated by the direct delivery part and drawn part calculating section 25 and the quantity of the intake-manifold wetting fuel $\tau m$ calculated by the intake-manifold wetting fuel calculating section 26 on the basis of formula (4), that is, $\tau e_{(i)}=\{\tau a_{(i)}-\beta\cdot\tau m_{(i)}\}/\alpha$.

The wet correction injection pulse width $\tau e$ is corrected by an ineffective injection time $\tau v$ which is calculated from a battery voltage by the ineffective injection time calculating section 28 and is added to the wet correction injection pulse width $\tau e$. The opening time of the fuel injection valve 14 is controlled by the value obtained by adding the ineffective injection time $\tau v$ to the wet correction injection pulse width $\tau e$ upon fuel injection.

An example of the fuel injection control in a fuel control system in accordance with an embodiment of the present invention will be described with reference to FIGS. 4 to 14, hereinbelow.

The control shown in FIGS. 4 to 14 is effected each top dead center which is detected by the crank angle sensor 17.

The control unit 16 first reads the output signal Q of the airflow meter 12 in step S1 and reads the engine speed N in step S2. Then in step S3, the control unit 16 calculates the basic charging efficiency Ceo according to formula $$CeO=Ka\cdot Q/N$$

wherein Ka is constant. In step S4, the control unit 16 calculates the cylinder charging efficiency Ce according to the following formula.

$$Kc\cdot Ce+(1-Kc)\cdot CeO$$

wherein Kc is constant not smaller than 0 and smaller than 1.

In step S5, the control unit 16 calculates the flow speed Qcyl at the fuel injection valve 14 according to formula $Qcyl=1/Ka\cdot Ce\cdot N$. In step S6, the control unit 16 reads the water temperature Tw.

Figure 8:
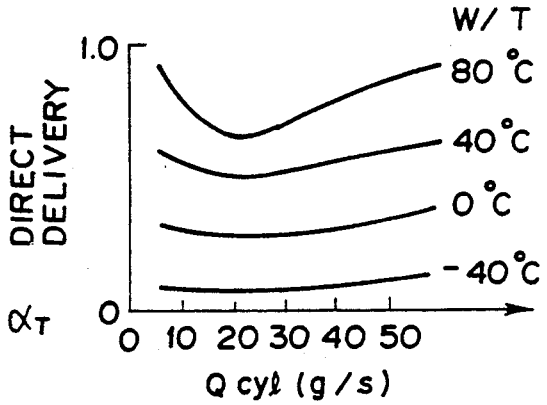
FIG. 8 is a map of the proportion of the directly delivery part for the trailing injection.
Figure 9:
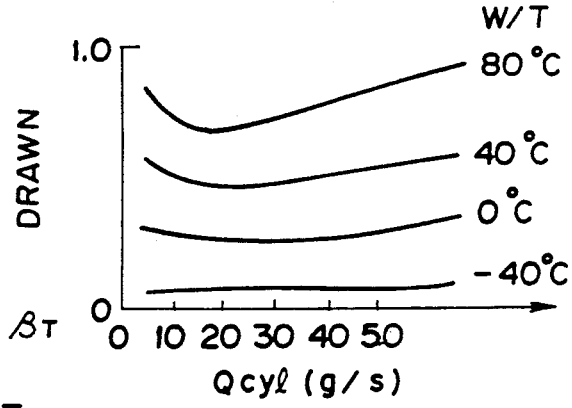
FIG. 9 is a map of the proportion of the drawn part for the trailing injection.
Figure 10:
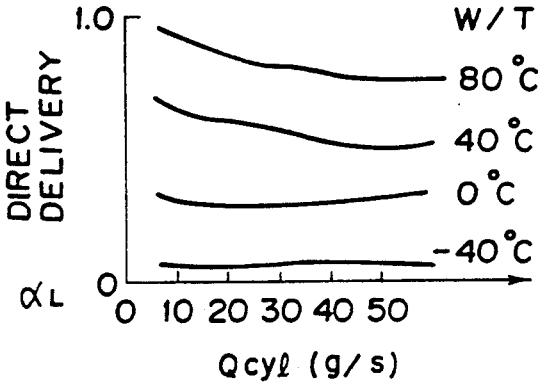
FIG. 10 is a map of the proportion of the directly delivery part for the leading injection.
Figure 11:
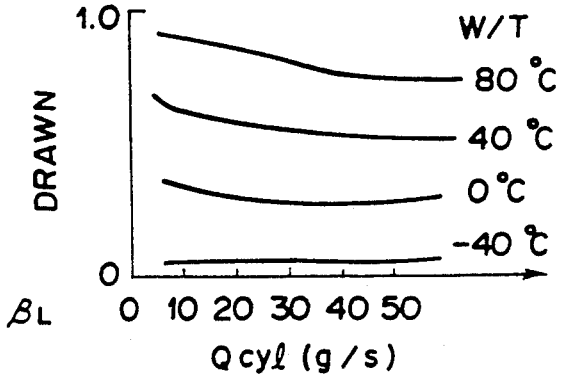
FIG. 11 is a map of the proportion of the drawn part for the leading injection.

In step S7, the control unit 16 calculates the proportion of the directly delivery part $\alpha_T$ for the trailing injection or for the injection effected in the intake stroke (In this embodiment, divided injection method is employed.) from the map such shown in FIG. 8 in which the flow speed Qcyl at the fuel injection valve 14 and the water temperature Tw are used as parameters. Then the control unit 16 calculates the proportion of the drawn part $\beta_T$ for the trailing injection, the proportion of the directly delivery part $\alpha_L$ for the leading injection or for the injection effected in the power stroke and the proportion of the drawn part $\beta_L$ for the leading injection respectively from the maps shown in FIGS. 9 to 11. (steps S8 to S10.)

Figure 12:
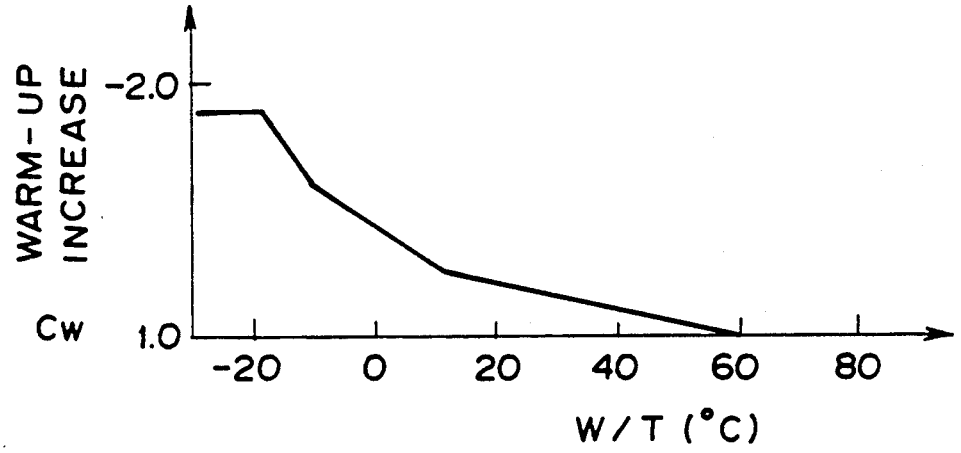
FIG. 12 is a fuel increase for warm-up-water temperature characteristic map.

Then in step S11, the control unit 16 calculates the fuel increase for warm-up Cw from the Cw-Tw (fuel increase for warm-up-water temperature characteristic) map shown in FIG. 12 according to the temperature of the cooling water Tw. In step S12, the control unit 16 calculates the basic fuel injection pulse width $\tau a$ by multiplying together the fuel increase for warm-up Cw, the cylinder charging efficiency Ce which was calculated in step S4 and a fuel injection constant $K_F$. The fuel increase for warm up Cw is proportional to the value obtained by dividing 1 by the combustion contribution.

Figure 13:
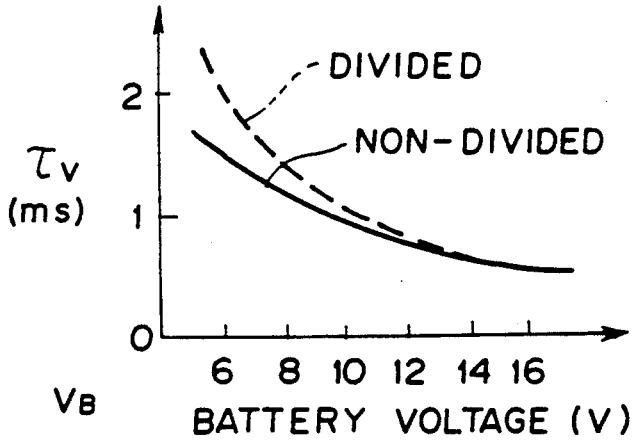
FIG. 13 is an ineffective injection time-battery battery voltage characteristic map.
Figure 14:
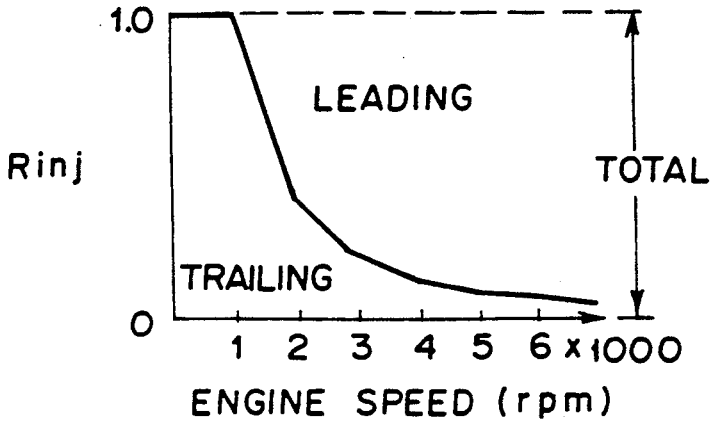
FIG. 14 is dividing ratio characteristic map.

After calculating the basic fuel injection pulse width $\tau a$, the control unit 16 reads the battery voltage $V_B$ in step S13, and calculates an ineffective injection time for the non-divided fuel injection $\tau V1$ and that for divided fuel injection $\tau V2$ according to the battery voltage $V_B$ from the $\tau V-V_B$ (ineffective injection time-battery voltage) characteristic map shown in FIG. 13. In step S15, the control unit 16 calculates the dividing ratio $R_{inj}$ (=the quantity of fuel to be injected by the trailing injection/the total quantity of fuel to be injected: $0\leqq R_{inj}\leqq 1$) according to the engine speed N from the map shown in FIG. 14.

In step S16, the control unit 16 determines whether the dividing ratio $R_{inj}$ is not smaller than a minimum dividing ratio $K_{rmn}$. The minimum dividing ratio $K_{rmn}$ is larger than 0 and smaller than 1. When it is determined that the dividing ratio $R_{inj}$ is not smaller than a minimum dividing ratio $K_{rmn}$, the control unit 16 determines whether the dividing ratio $R_{inj}$ is not larger than 1 minus the minimum dividing ratio $K_{rmn}$. ( Step S17) When it is determined in step S17 that the dividing ratio $R_{inj}$ is not larger than 1 minus the minimum dividing ratio $K_{rmn}$, the control unit 16 sets a division inhibiting flag $F_{rinh}$ to 0. (step S18) Then in step S19, the control unit 16 sets the ineffective injection time for divided fuel injection $\tau V2$ to an ineffective injection time $\tau V$ which is a practical value. The control unit 16 executes the sub routine for the leading injection shown in FIG. 5 in step S20 and executes the sub routine for the trailing injection shown in FIG. 6 in step S21. Thereafter, the control unit 16 returns the time-synchronized routine.

When it is determined in step step S16 that the dividing ratio $R_{inj}$ is smaller than a minimum dividing ratio $K_{rmn}$, the control unit 16 nullifies the dividing ratio $R_{inj}$ step S22, that is, the control unit 16 causes the fuel injection valve 14 to inject the total quantity of fuel to be injected solely by the leading injection. When it is determined in step S17 that the dividing ratio $R_{inj}$ is larger than 1 minus the minimum dividing ratio $K_{rmn}$, the control unit 16 sets the dividing ratio $R_{inj}$ to 1 in step S23, that is, the control unit 16 causes the fuel injection valve 14 to inject the total quantity of fuel to be injected solely by the trailing injection. Then the control unit 16 sets the division inhibiting flag $F_{rinh}$ to 1 in step S24 and sets in step S25 the ineffective injection time for non-divided fuel injection $\tau V1$ to the ineffective injection time $\tau V$ which is a practical value. Thereafter, the control unit 16 proceeds to step S20.

Figure 5:
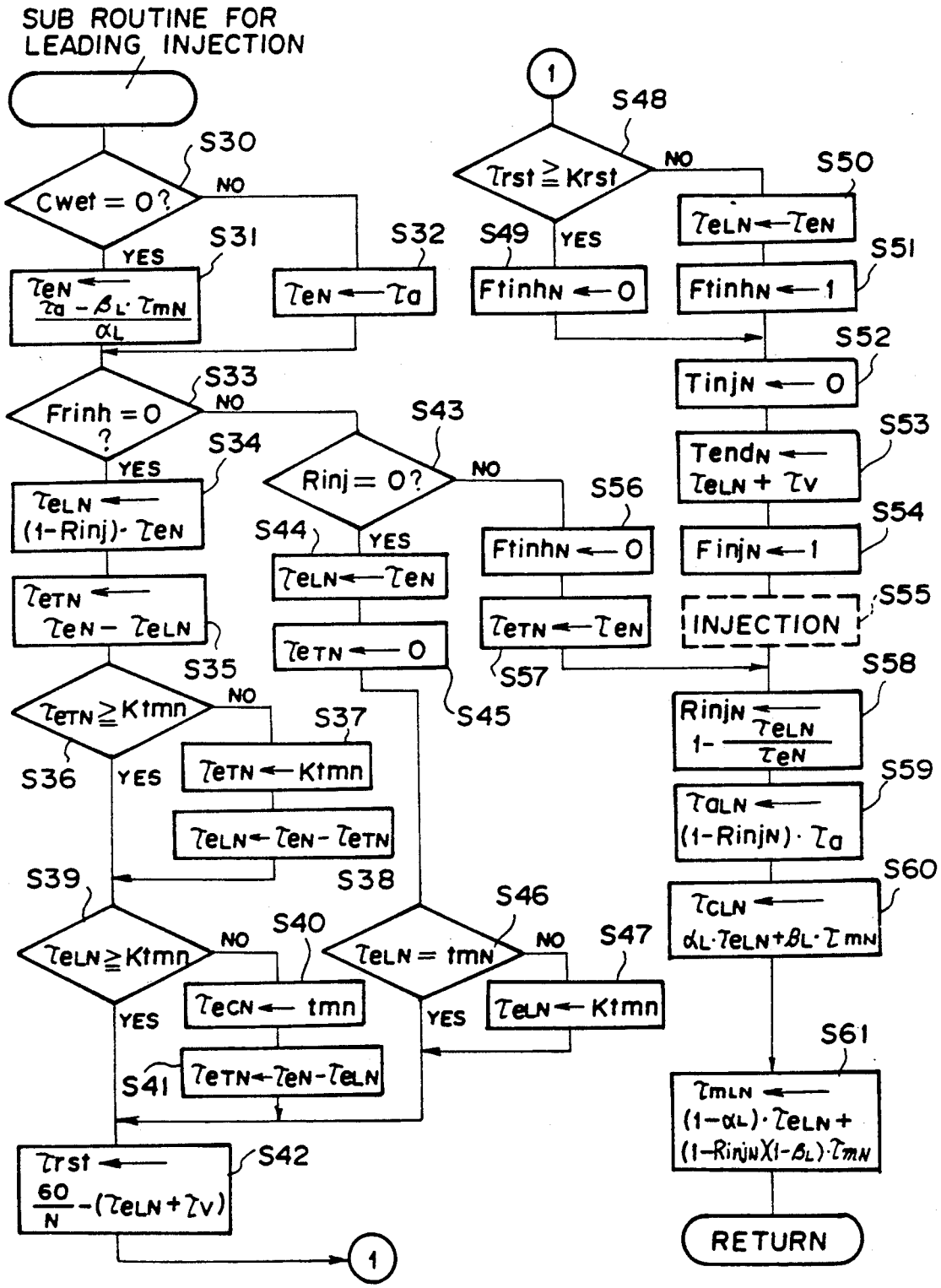
FIG. 5 is a flow chart showing a sub routine which the control unit executes for the leading injection for a N-th cylinder.

The sub routine for the leading injection for a N-th cylinder will be described with reference to FIG. 5, hereinbelow.

In this sub routine, the control unit 16 determines in step S30 whether wet correction inhibiting counter $C_{wet}$ is 0. When it is determined in step S30 that the wet correction inhibiting counter $C_{wet}$ is 0, the control unit 16 calculates the wet correction injection pulse width $\tau eN$ for N-th cylinder according to a formula similar to the formula (4) in step S31. Otherwise, the control unit 16 sets $\tau eN$ to the basic fuel injection pulse width $\tau a$ in step S32. Thereafter the control unit 16 determines in step S33 whether the division inhibiting flag $F_{rinh}$ is 0. When it is determined that the division inhibiting flag $F_{rinh}$ is 0, the control unit 16 calculates in step S34 the leading injection pulse width $\tau eLN$ on the basis of the wet correction injection pulse width $\tau eN$ and the dividing ratio $R_{inj}$. Then in step S35, the control unit 16 subtracts the leading injection pulse width $\tau eLN$ from the wet correction injection pulse width $\tau eN$, thereby obtaining an initial value of the trailing injection pulse width $\tau eTN$.

In step S36, the control unit 16 determines whether the initial value of the trailing injection pulse width $\tau eTN$ is not smaller than a minimum limit $K_{tmn}$ of the pulse width. When it is determined in step S36 that the initial value of the trailing injection pulse width $\tau eTN$ is smaller than a minimum limit $K_{tmn}$ of the pulse width, the control unit 16 sets the trailing injection pulse width $\tau eTN$ to the minimum limit $K_{tmn}$ in step S37. Then in step S38, the control unit 16 subtracts the trailing injection pulse width $\tau eTN$ from the wet correction injection pulse width $\tau eN$ and sets the leading injection pulse width $\tau eLN$ to the value obtained. On the other hand, when it is determined in step S36 that the initial value of the trailing injection pulse width $\tau eTN$ is not smaller than a minimum limit $K_{tmn}$ of the pulse width, the control unit 16 determines in step S39 whether the leading injection pulse width $\tau eLN$ is not smaller than the minimum limit $K_{tmn}$ of the pulse width. When it is determined that the leading injection pulse width $\tau eLN$ is not smaller than the minimum limit $K_{tmn}$ of the pulse width, the control unit 16 directly proceeds to step S42 and otherwise, the control unit 16 proceeds to step S42 by way of steps S40 and S41. In steps S40 and S41, the control unit 16 sets the leading injection pulse width $\tau eLN$ to the minimum limit $K_{tmn}$ and sets trailing injection pulse width $\tau eTN$ to the value obtained by subtracting the leading injection pulse width $\tau eLN$ set in step S40 from the wet correction injection pulse width $\tau eN$. In step S42, the control unit 16 calculates the rest time $\tau rst$ of the fuel injection valve 14 according to the following formula.

$$60/N-(\tau eLN+\tau v)$$

wherein $\tau v$ represents the ineffective injection time.

When it is determined in step S33 that the division inhibiting flag $F_{rinh}$ is 0, the control unit 16 determines in step S43 whether the dividing ratio $R_{inj}$ is 0, that is, the fuel injection valve 14 is to inject the total quantity of fuel to be injected solely by the leading injection. When the answer to this question is YES, the control unit 16 sets the leading injection pulse width $\tau eLN$ to the wet correction injection pulse width $\tau eN$ as it is and sets the trailing injection pulse width $\tau eTN$ to 0. (steps S44 and S45) Then in step S46, the control unit 16 determines whether the leading injection pulse width $\tau eLN$ is not smaller than the minimum limit $K_{tmn}$ of the pulse width. When the answer to this question is YES, the control unit 16 directly proceeds to step S42. Otherwise the control unit 16 proceeds to step S42 after setting the leading injection pulse width $\tau eLN$ to the minimum limit $K_{tmn}$ of the pulse width.

After step S42, the control unit 16 determines in step S48 whether the rest time $\tau rst$ of the fuel injection valve 14 is not smaller than a minimum limit Ktrst of the rest time. When the answer to this question is YES, the control unit 16 sets a trailing injection inhibiting flag $F_{tinhN}$ to 0 in Step S49, and otherwise, sets in step S50 the leading injection pulse width $\tau eLN$ to the the wet correction injection pulse width $\tau eN$ as it is. Then control unit 16 sets the trailing injection inhibiting flag $F_{tinhN}$ to 1 in step S51.

Thereafter the control unit 16 resets a timer $T_{injN}$ in step S52, and in step S53, the control unit 16 sets the ending time of the injection or the pulse width $T_{endN}$ to the value obtained by adding the ineffective injection time $\tau v$ to the leading injection pulse Width $\tau reLN$. Then the control unit 16 causes the fuel injection valve 14 to inject fuel in step S55 after setting an injection start signal $F_{injN}$ to 1 in step S54.

When it is determined in step S43 that the dividing ratio $R_{inj}$ is not 0, the control unit 16 sets the trailing injection inhibiting flag $F_{tinh}$ to 0 in step S56 and sets in step S57 the trailing injection pulse width $\tau eTN$ to the the wet correction injection pulse width $\tau eN$ as it is.

Further, in step S58, the control unit 16 calculates an effective dividing ratio $R_{injN}$ according to formula $$1-\tau eLN/\tau eN$$

and then calculates in step S59 the pulse width allotted to the leading injection $\tau aLN$ in the basic injection pulse width $\tau a$ according to the following formula.

$$(1-R_{injN})\cdot\tau a$$

Then the control unit 16 calculates in step S60 the total quantity of fuel $\tau_{CLN}$ to be fed to the cylinder by the leading injection according to the following formula which corresponds to the formula (2).

$$\alpha_L\cdot\tau aLN+\beta_L\cdot\tau m_N$$

Finally the control unit 16 calculates in step S61 the quantity of the intake-manifold wetting fuel after the leading injection $\tau m_{LN}$ according to the following formula which corresponds to the formula (1).

$$(1-\alpha_L)\tau aLN+(1-R_{injN})\cdot(1-\beta_L)\tau m_N$$

The sub routine for the trailing injection for a N-th cylinder will be described with reference to FIG. 6, hereinbelow.

In step S70, the control unit 16 determines whether the quantity of fuel corresponding to the basic injection pulse width $\tau a$ is not smaller than the quantity of fuel $\tau_{CLN}$ which is fed to the cylinder by the leading injection. When it is determined that the former is not smaller than the latter, the control unit 16 determines in step S71 whether wet correction inhibiting counter $C_{wet}$ is 0. When it is determined in step S71 that the wet correction inhibiting counter $C_{wet}$ is 0, the control unit 16 determines in step S72 whether trailing injection inhibiting flag FtinhN is 0. When it is determined that the trailing injection inhibiting flag $F_{tinhN}$ is 0, the control unit 16 calculates the wet correction injection pulse width $\tau$eN for N-th cylinder according to a formula similar to the formula (4) in step S73. In the next step S74, the control unit 16 calculates the trailing injection pulse width $\tau$eTN in the divided injection according to the following formula.

$$(\tau a-\tau aLN-R_{injN}19\ \beta_T\tau m_N)/\alpha_T$$

wherein $\tau$aLN represents the pulse width allotted to the leading injection $\tau$aLN and $R_{injN}$ represents the effective dividing ratio $R_{injN}$.

Thereafter, the control unit 16 determines in step S75 whether the division inhibiting flag $F_{rinh}$ is 0. When it is determined that the division inhibitinq flag $F_{rinh}$ is 0, the control unit 16 determines whether the trailing injection pulse width $\tau$eTN is not smaller than a minimum limit $K_{tmn}$ of the pulse width. When it is determined in step S76 that the trailing injection pulse width $\tau$eTN is not smaller than a minimum limit $K_{tmn}$ of the pulse width, the control unit 16 calculates the rest time $\tau$rst of the fuel injection valve 14 according to the following formula.

$$60/N-(\tau eTN+\tau v)$$

wherein $\tau$v represents the ineffective injection time.

In step S78, the control unit 16 determines whether the rest time $\tau$rst of the fuel injection valve 14 is not smaller than a minimum limit Ktrst of the rest time. When the answer to this question is NO, the control unit 16 calculates in step S79 the trailing injection pulse width $\tau$eTN according to formula 60/N(Ktrst+$\tau$v), and then proceeds to step S80. Otherwise, the control unit 16 directly proceeds to step S80. In step S80, the control unit 16 resets a timer $T_{injN}$, and in step S81, the control unit 16 sets the ending time of the injection or the pulse width $T_{endN}$ to the value obtained by adding the ineffective injection time $\tau$v to the trailing injection pulse width reTN. Then the control unit 16 causes the fuel injection valve 14 to inject fuel in step S83 after setting an injection start signal $F_{injN}$ to 1 in Step S82.

Finally the control unit 16 calculates in step S84 the total quantity of the intake-manifold wetting fuel $\tau m_N$ according to the following formula.

$$(1-\alpha_T)\tau eTN+R_{injN}\cdot(1-\beta_T)\tau m_N+\tau mLN$$

When the answer to the question in step S70 is NO, the control unit 16 proceeds to step S84.

When the answer to the question in step S71 is NO, that is, when the wet correction is not to be made, the control unit 16 sets $\tau$eN to the basic fuel injection pulse width $\tau$a in step S85. Thereafter the control unit 16 determines in step S86 whether the trailing injection inhibiting flag $F_{tinhN}$ is 0. When it is determined that the trailing injection inhibiting flag $F_{tinhN}$ is 0, the control unit 16 subtracts the leading injection pulse width $\tau$aLN from the basic injection pulse width $\tau$a, and sets the trailing injection pulse width $\tau$eTN to the difference. (step S87) Thereafter the control unit 16 proceeds to step S75.

Figure 6:
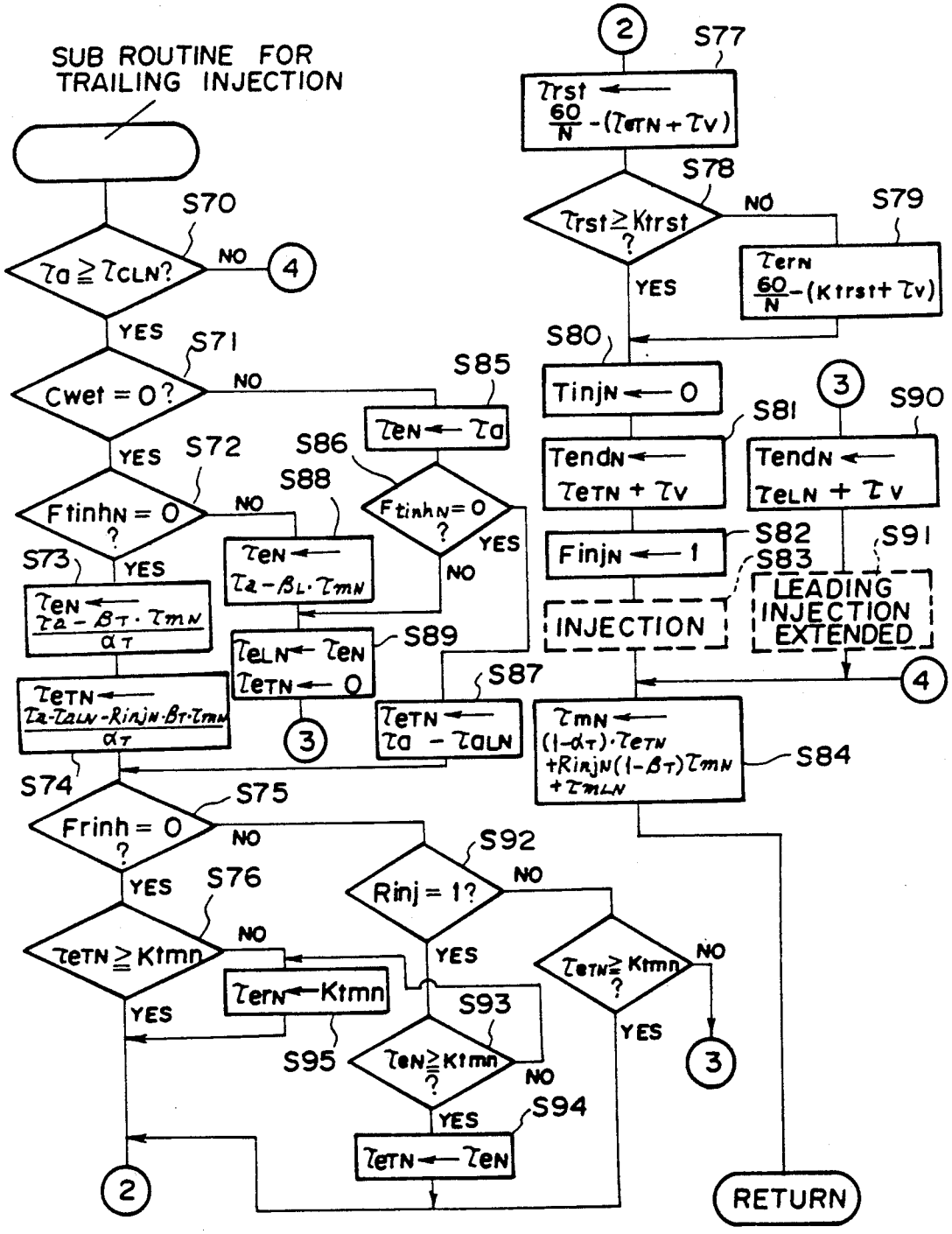
FIG. 6 is a flow chart showing a sub routine which the control unit executes for the trailing injection for the N-th cylinder.

When the answer to the question in step S72 is NO, that is, when the trailing injection is inhibited, the control unit 16 calculates in step S88 the wet correction injection pulse width $\tau$eN according to the formula which is shown in FIG. 6 and corresponds to the formula (4). Then in step S89, the control unit 16 sets the leading injection pulse width $\tau$eLN to the wet correction injection pulse width $\tau$eN obtained in step S88, and sets the trailing injection pulse width $\tau$eTN to 0. In step S90, the control unit 16 sets the ending time of the injection or the pulse width $T_{endN}$ to the value obtained by adding the ineffective injection time $\tau$v to the leading injection pulse width $\tau$eLN. Then the control unit 16 proceeds to step S84 after extending the leading injection time in step S91.

When it is determined in step S75 that the division inhibiting flag $F_{rinh}$ is not 0, that is, when the divided injection is not to be effected, the control unit 16 determines in step S92 whether the dividing ratio $R_{inj}$ is 1, that is, which is to be effected the leading injection or the trailing injection. When it is determined that the dividing ratio $R_{inj}$ is 1, the control unit 16 determines in step S93 whether the wet correction injection pulse width $\tau$eN is not smaller than the minimum limit $K_{tmn}$ of the pulse width. When it is determined that the wet correction injection pulse width $\tau$eN is not smaller than the minimum limit $K_{tmn}$ of the pulse width, the control unit 16 sets in step S94 the trailing injection pulse width $\tau$eTN to the wet correction injection pulse width $\tau$eN and then proceeds to step S77. Otherwise, the control unit 16 sets in step S95 the trailing injection pulse width $\tau$eTN to the minimum limit $K_{tmn}$ of the pulse width and then proceeds to step S77. When the answer to the question in step S76 is NO, the control unit 16 proceeds to step S77 after executing step S95.

Figure 7:
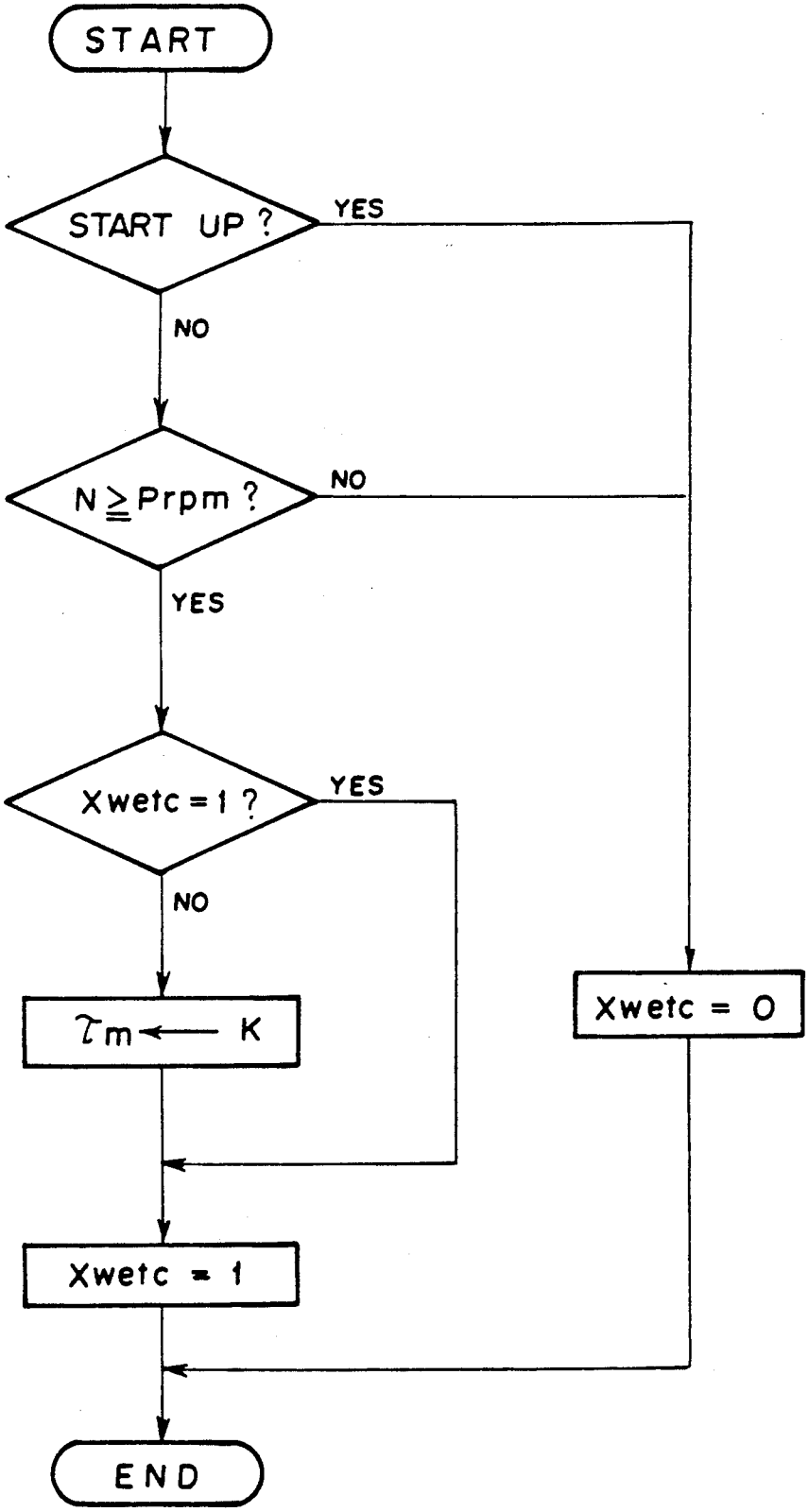
FIG. 7 is a flow chart showing a sub routine which the control unit executes during start-up of the engine.

When the engine is started up, the control unit 16 executes the flow chart shown in FIG. 7 and fixes the value of $\tau m_N$ until the start-up of the engine is completed. In FIG. 7, Xwetc is a wet correction inhibiting counter.

We claim:

1. A fuel control system for an internal combustion engine in which a quantity of fuel injected from a fuel injection means is determined on the basis of a quantity of a direct delivery part of fuel directly delivered to a combustion chamber from a fuel injector and a quantity of a drawn part of fuel delivered from an intake-manifold wetting fuel adhered to a wall surface of an intake-manifold, wherein a quantity of the intake-manifold wetting fuel, on the basis of which the quantity of said drawn part fuel is calculated, is calculated on the basis of a quantity of an adhering apart of the fuel which was injected through a preceding injection by the fuel injection means and a quantity of a residual part of a preceding intake-manifold wetting fuel and wherein the quantity of said intake-manifold wetting fuel is calculated according to formula $$\tau m=(1-\alpha)\cdot\tau e_{(i-1)}+(1-\beta)\cdot\tau m_{(i-31)}$$

where $\tau$m represents the quantity of the intake-manifold wetting fuel, $\alpha$ represents the proportion of the direct delivery part fuel which is empirically determined, $\beta$ represents the proportion of the drawn part fuel which is empirically determined, $\tau e_{(i-1)}$ represents the quantity of fuel which was injected through the preceding injection and $\tau m_{(i-1)}$ represents the quantity of the preceding intake-manifold wetting fuel.

2. A fuel control system as defined in claim 1 in which said proportion of the direct delivery part fuel is changed according to the temperature of engine cooling water.

3. A fuel control system as defined in claim 1 in which said proportion of the drawn part fuel is changed according to the temperature of engine cooling water.

4. A fuel control system as defined in claim 1 in which said proportion of the direct delivery part fuel is changed according to the flow speed of intake air at the fuel injection means.

5. A fuel control system as defined in claim 4 in which said proportion of the direct delivery part fuel is read out from a map in which the proportion of the direct delivery part fuel is stored as a function of the flow speed of intake air at the fuel injection means.

6. A fuel control system as defined in claim 1 in which said proportion of the drawn part fuel is changed according to the flow speed of intake air at the fuel injection means.

7. A fuel control system as defined in claim 6 in which said proportion of the drawn part fuel is read out from a map in which the proportion of the drawn part fuel is stored as a function of the flow speed of intake air at the fuel injection means.

8. A fuel control system as defined in claim 1 in which the quantity of the intake-manifold wetting fuel is changed dependent upon whether the engine is in a start-up operation.

9. A fuel control system as defined in claim 8 in which the quantity of the intake-manifold wetting fuel is fixed at a constant during start-up of the engine.

10. A fuel control system as defined in claim 1 in which the quantity of fuel to be actually fed to the engine is divided into first and second parts, and fuel is injected by leading injection and trailing injection, fuel being injected by the leading injection in a quantity of the direct delivery part fuel of which provides the first part of the quantity of fuel to be actually fed to the engine, together with the drawn part fuel derived from the intake-manifold wetting fuel at the preceding trailing injection and fuel being injected by the trailing injection in a quantity of the direct delivery part fuel of which provides the second part of the quantity of fuel to be actually fed to the engine together with the drawn part fuel derived from the intake-manifold wetting fuel at the preceding leading injection.

* * * * *